US009546495B2

(12) United States Patent
Shiomi et al.

(10) Patent No.: US 9,546,495 B2
(45) Date of Patent: Jan. 17, 2017

(54) METHOD FOR CONSTRUCTING CYLINDRICAL TANK

(71) Applicant: IHI Corporation, Tokyo (JP)

(72) Inventors: Hiroshi Shiomi, Tokyo (JP); Noriyuki Katsuyama, Tokyo (JP); Norio Uchiyama, Tokyo (JP); Satoru Nagumo, Tokyo (JP); Masaki Takahashi, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 14/668,416

(22) Filed: Mar. 25, 2015

(65) Prior Publication Data

US 2015/0197953 A1 Jul. 16, 2015

Related U.S. Application Data

(63) Continuation of application No. PCT/JP2013/067853, filed on Jun. 28, 2013.

(30) Foreign Application Priority Data

Nov. 6, 2012 (JP) ..... 2012-244690

(51) Int. Cl.
*E04B 1/00* (2006.01)
*E04G 21/00* (2006.01)
(Continued)

(52) U.S. Cl.
CPC . *E04H 7/02* (2013.01); *E04B 7/10* (2013.01); *E04B 7/102* (2013.01); *E04H 7/04* (2013.01);
(Continued)

(58) Field of Classification Search
CPC ..... E04H 7/065; E04H 7/00; E04H 7/02; E04H 7/24
(Continued)

(56) References Cited

U.S. PATENT DOCUMENTS 1,839,578 A * 1/1932 Morton ..... 29/429
1,846,506 A * 2/1932 Wiggins ..... 220/565
(Continued)

FOREIGN PATENT DOCUMENTS

CN 101858161 A 10/2010
JP 61-233177 A 10/1986
(Continued)

OTHER PUBLICATIONS

International Search Report mailed Aug. 13, 2013 in PCT/JP2013/067853 (4 pages).
(Continued)

*Primary Examiner* — Chi Q Nguyen
(74) *Attorney, Agent, or Firm* — Rothwell, Figg, Ernst & Manbeck, P.C.

(57) ABSTRACT

A method for constructing a cylindrical tank which has a metallic inner tank and a concrete outer tank includes a step of building up a PC wall in an outer circumferential edge portion of a base plate, a step of assembling an outer tank roof on the base plate other than the outer circumferential edge portion of the base plate, a step of lifting the outer tank roof which is on the base plate using a jack-up unit while the PC wall is being built up and then holding the outer tank roof on the PC wall, and a step of assembling the inner tank independently of the outer tank roof in a space under the outer tank roof which is created due to the lifting.

8 Claims, 15 Drawing Sheets

(51) Int. Cl.

| | |
|---|---|
| ***E04G 23/00*** | (2006.01) |
| ***E04H 7/02*** | (2006.01) |
| ***E04H 7/06*** | (2006.01) |
| ***E04H 7/18*** | (2006.01) |
| ***E04B 7/10*** | (2006.01) |
| ***E04H 7/04*** | (2006.01) |
| *B65D 90/02* | (2006.01) |
| *E04H 7/28* | (2006.01) |
| *E04H 7/00* | (2006.01) |
| *B65D 88/08* | (2006.01) |
| *B65D 88/02* | (2006.01) |
| *E04H 7/24* | (2006.01) |
| *E04G 11/04* | (2006.01) |

(52) U.S. Cl.
CPC ..... *E04H 7/06* (2013.01); *E04H 7/065* (2013.01); *E04H 7/18* (2013.01); *B65D 88/02* (2013.01); *B65D 88/08* (2013.01); *B65D 90/02* (2013.01); *E04G 11/04* (2013.01); *E04H 7/00* (2013.01); *E04H 7/24* (2013.01); *E04H 7/28* (2013.01); *F17C 2201/0109* (2013.01); *F17C 2201/032* (2013.01); *F17C 2201/052* (2013.01); *F17C 2203/0636* (2013.01)

(58) Field of Classification Search
USPC ..... 52/745.01, 80.1, 223.2, 245
See application file for complete search history.

(56) References Cited

U.S. PATENT DOCUMENTS

| | | | | | |
|---|---|---|---|---|---|
| 2,045,478 | A | * | 6/1936 | Kuehn | B65D 90/12 220/565 |
| 2,057,682 | A | * | 10/1936 | Horton et al. | 220/565 |
| 2,237,308 | A | * | 4/1941 | Larson | 220/653 |
| 2,263,943 | A | * | 11/1941 | Ferguson | 220/565 |
| 2,378,126 | A | * | 6/1945 | Blair | 220/565 |
| 2,378,128 | A | * | 6/1945 | Cates | 217/4 |
| 2,649,059 | A | * | 8/1953 | Mercier | E04H 7/065 52/416 |
| 2,708,012 | A | * | 5/1955 | Talcott | 254/89 R |
| 2,928,565 | A | * | 3/1960 | Glasoe, Jr. | 220/567.2 |
| 2,984,898 | A | * | 5/1961 | Svensson | E04H 7/06 220/565 |
| 3,018,546 | A | * | 1/1962 | Dewese | 29/431 |
| 3,057,054 | A | * | 10/1962 | Barnes | E04H 7/06 220/565 |
| 3,131,908 | A | * | 5/1964 | Payton | 254/89 H |
| 3,199,839 | A | * | 8/1965 | Linder et al. | 254/89 R |
| 3,427,777 | A | * | 2/1969 | Crowley | E04B 1/3211 264/274 |
| 3,559,835 | A | * | 2/1971 | Lange | 220/560.12 |
| 3,595,291 | A | * | 7/1971 | Grunhoff et al. | 220/565 |
| 3,701,262 | A | * | 10/1972 | Connell et al. | 62/53.1 |
| 3,852,973 | A | * | 12/1974 | Marothy | F17C 3/022 220/560.05 |
| 4,062,468 | A | * | 12/1977 | Bongiovanni | 220/567.2 |
| 4,163,347 | A | * | 8/1979 | Marcmann | B65D 90/06 177/233 |
| 4,177,915 | A | * | 12/1979 | Blankenburg | 228/184 |
| 4,884,711 | A | * | 12/1989 | Bomhard et al. | 220/565 |
| 5,105,590 | A | * | 4/1992 | Dykmans | 52/745.01 |
| 5,271,193 | A | * | 12/1993 | Olsen et al. | 52/19 |
| 5,287,986 | A | * | 2/1994 | Frost | 220/565 |
| 6,282,863 | B1 | * | 9/2001 | Christian et al. | 52/747.1 |
| 8,603,375 | B2 | * | 12/2013 | Simmons | F17C 3/022 220/560.04 |
| 2005/0144864 | A1 | * | 7/2005 | Skovholt | F17C 3/022 52/223.3 |
| 2008/0302804 | A1 | * | 12/2008 | Simmons et al. | 220/560.05 |
| 2010/0154319 | A1 | * | 6/2010 | Shockley | E04H 7/18 52/82 |
| 2010/0154332 | A1 | * | 6/2010 | Shockley et al. | 52/223.3 |
| 2011/0289865 | A1 | * | 12/2011 | Martens et al. | 52/173.1 |
| 2015/0053692 | A1 | * | 2/2015 | Uchiyama | 220/560.1 |
| 2015/0267434 | A1 | | 9/2015 | Shiomi et al. | |

FOREIGN PATENT DOCUMENTS

| | | | |
|---|---|---|---|
| JP | 4-370797 | A | 12/1992 |
| JP | 6-313376 | A | 11/1994 |
| JP | 7-253196 | A | 10/1995 |
| JP | 2002-349087 | A | 12/2002 |
| JP | 2003-10968 | A | 1/2003 |
| JP | 2004-144223 | A | 5/2004 |
| JP | 2004-353319 | A | 12/2004 |
| JP | 2012-1968 | A | 1/2012 |
| JP | 2012-149416 | A | 8/2012 |
| KR | 10-0901728 | B1 | 6/2009 |
| SU | 1597437 | A2 | 10/1990 |
| TW | 406721 | U | 9/2000 |
| WO | 2012/137671 | A1 | 10/2012 |

OTHER PUBLICATIONS

Examination Report from the Intellectual Property Office and Search Report mailed in corresponding Taiwan Patent Application No. 102123437 (with an English translation) (7 pages).

U.S. Appl. No. 14/959,154, Yamada, et al., filed Dec. 4, 2015.

U.S. Appl. No. 14/967,615, Deguchi, et al., filed Dec. 14, 2015.

Notice of Non-Final Rejection mailed Sep. 30, 2015 in corresponding Korean Patent Application No. 10-2015-7002770 (with an English translation) (10 pages).

* cited by examiner

METHOD FOR CONSTRUCTING CYLINDRICAL TANK

CROSS-REFERENCE TO RELATED APPLICATIONS

This application is a continuation application based on PCT Patent Application No. PCT/JP2013/067853, filed Jun. 28, 2013, whose priority is claimed to Japanese Patent Application No. 2012-244690, filed Nov. 6, 2012. The contents of both the PCT Application and the Japanese Application are incorporated herein by reference.

TECHNICAL FIELD

The present invention relates to a method for constructing a cylindrical tank.

BACKGROUND ART

Cylindrical tanks with a structure having an inner tank and an outer tank are being used to store cryogenic liquids such as liquefied natural gas (LNG), liquefied petroleum gas (LPG), and the like. Patent Document 1 discloses a method for constructing a cylindrical tank having a metallic inner tank and an outer tank that is made of precast (PC) concrete.

In the method for constructing a cylindrical tank, PC sidewalls that will form an outer tank are stood from a base portion that is formed of concrete, a roof that has been assembled on the base portion is air-raised, and an outer tank roof is mounted on a top portion of the PC walls. Then, an annular portion is laid on the base portion, and then an inner tank is set up on the annular portion. The inner tank is assembled by welding a plurality of inner tank lateral plates which are carried in from a construction site entrance of the PC walls in a circular shape, and then welding the inner tank lateral plates from a lowermost level to an uppermost level in order. Then, by laying a cold insulation material on the base portion and filling an inner-outer-tank gap with another cold insulation material, a cylindrical tank that has a function of keeping LNG and the like cool is constructed.

CITATION LIST

Patent Document

[Patent Document 1]
Japanese Unexamined Patent Application, First Publication No. 2004-353319

SUMMARY OF INVENTION

Technical Problem

In recent years, however, there has been a demand for a shortened construction period for such a cylindrical tank. In the related art described above, after the sidewalls of the outer tank are set up, the outer tank roof is mounted on the sidewalls of the outer tank through air-raising, and then the inner tank is set up. For this reason, all of the respective work becomes a critical path, and thus it is not possible to satisfactorily achieve shortening of the construction period of the cylindrical tank.

The present invention takes the above-described problem into consideration, and thus aims to provide a method for constructing a cylindrical tank that can achieve shortening of a construction period.

Solution to Problem

In order to achieve the aforementioned object, according to a first aspect of the present invention, a method for constructing a cylindrical tank which has a metallic inner tank and a concrete outer tank includes a step of building up a sidewall of the outer tank in an outer circumferential edge portion of a base portion of the outer tank, a step of assembling a roof portion of the outer tank on the base portion of the outer tank other than the outer circumferential edge portion, a step of lifting the roof portion of the outer tank which is on the base portion of the outer tank using a jack-up unit while the sidewall of the outer tank is being built up and then holding the roof portion on the sidewall of the outer tank, and a step of assembling the inner tank independently of the roof portion of the outer tank in a space under the roof portion of the outer tank which is created due to the lifting.

According to the first aspect of the present invention, the sidewall of the outer tank is built up in the outer circumferential edge portion of the base portion of the outer tank, and the roof portion of the outer tank is assembled on the base portion of the outer tank other than the outer circumferential portion in parallel therewith. In addition, after the roof portion of the outer tank is assembled to some degree, the roof portion is lifted using the jack-up unit to be held on the sidewall of the outer tank during the building-up, and thus the space in which the inner tank is assembled is secured under the roof portion of the outer tank. Accordingly, in the present invention, since the building-up of the sidewall of the outer tank, the assembly of the roof portion of the outer tank, and the assembly of the inner tank can be performed simultaneously, the construction period can be greatly shortened.

In addition, according to a second aspect of the present invention, a step of assembling the roof portion of the outer tank in a state in which the roof portion is held on the sidewall of the outer tank is included.

According to the second aspect of the present invention, before the roof portion of the outer tank is finally mounted on a top portion of the sidewall of the outer tank, the roof portion of the outer tank is assembled in the state immediately before its completion (for example, including bar reinforcement work for concrete placement of the roof) in advance in the state in which the roof portion is held in the middle level of the sidewall of the outer tank. Accordingly, in the present invention, after the building-up of the sidewall of the outer tank is completed, the roof portion of the outer tank is mounted on the top portion thereof, and thus the outer tank can be completed quickly.

In addition, according to a third aspect of the present invention, a step of assembling the inner tank by alternately repeating lifting of an inner tank lateral plate using a jack-up unit and attachment of a next inner tank lateral plate to a lower side of the lifted inner tank lateral plate is included.

According to the third aspect of the present invention, by continuously lifting the inner tank lateral plate using the jack-up unit and adding inner tank lateral plates on the lower side in order, the continuous addition of the inner tank lateral plates is performed at a low position. For this reason, while interference with the roof portion of the outer tank being held in the middle level of the sidewall of the outer tank is avoided, the inner tank assembly work can be safely performed at the low position.

In addition, according to a fourth aspect of the present invention, the sidewall of the outer tank is built up by placing concrete using an outer tank lateral plate as an inner side mold. In addition, according to the fourth aspect of the present invention, a step of forming an opening portion in the outer tank lateral plate in advance, a step of fitting an anchor portion which is connected to an anchor that is embedded in the concrete in the opening portion, and a step of supporting the jack-up unit via the anchor portion that is fitted in the opening portion are included.

According to the fourth aspect of the present invention, the jack-up unit bears the weight of the roof portion of the outer tank when lifting the roof portion, and bears the weight of the inner tank lateral plates when lifting the inner tank lateral plates. In order to cause the sidewall of the outer tank to receive the load exerted on the jack-up unit, the anchor portion is fitted in the opening portion that is provided in the outer tank lateral plate in advance to be integrated with the outer tank lateral plate. Accordingly, it is not necessary to secure strength to bear the jack-up unit by thickening a plate thickness of the outer tank lateral plate or the like, and thus a necessary anchor point can be secured while maintaining the plate thickness of the outer tank lateral plate at a requisite minimum level.

In addition, according to a fifth aspect of the present invention, a step of providing the jack-up unit at a top portion of the sidewall of the outer tank after the sidewall of the outer tank is built up to lift the roof portion of the outer tank, a step of providing a protruding portion on an inner circumferential face of the sidewall of the outer tank to regulate a height at which the roof portion of the outer tank is lifted, and a step of attaching the roof portion of the outer tank whose height is regulated by the protruding portion to the inner circumferential face of the sidewall of the outer tank via a coupler are included.

When the jack-up unit is provided at the top portion of the sidewall of the outer tank in order to raise up the roof portion of the outer tank being held in the middle level of the sidewall of the outer tank, it is not possible to mount the roof portion of the outer tank at the location of the jack-up unit. For this reason, according to the fifth aspect of the present invention, by providing the protruding portion on the inner circumferential face of the sidewall of the outer tank to set the portion as a final installation position of the roof portion of the outer tank, a height of the roof portion of the outer tank is regulated. In addition, by providing the coupler on the inner circumferential face of the sidewall of the outer tank, the roof portion of the outer tank is mounted on the inner circumferential face of the sidewall of the outer tank via the coupler. Accordingly, for example, bar reinforcement work on the roof portion of the outer tank is started in a state in which the roof portion is held in the middle level of the sidewall of the outer tank, and after building-up of the sidewall of the outer tank is completed, the roof portion of the outer tank can be quickly mounted on the inner circumferential face of the sidewall of the outer tank via the coupler.

Advantageous Effects of Invention

According to the present invention, a method for constructing a cylindrical tank with which a construction period can be shortened can be obtained.

DESCRIPTION OF EMBODIMENT

Hereinafter, an embodiment of the method for constructing a cylindrical tank of the present invention will be described with reference to drawings.

Figure 1:
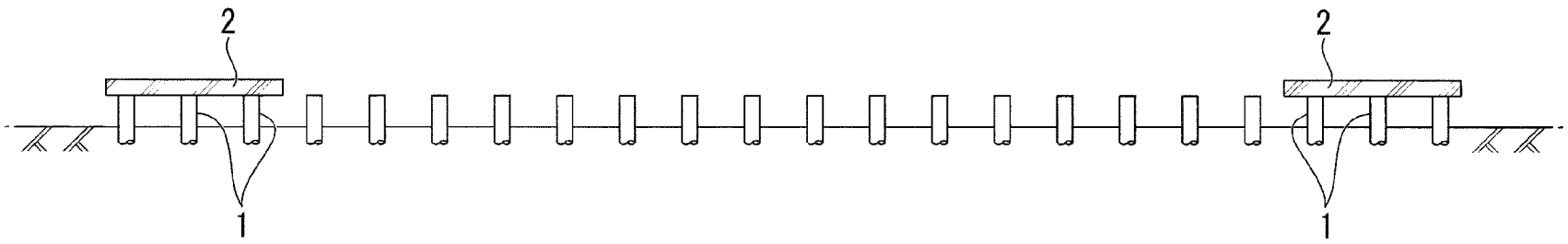
FIG. 1 is a diagram showing a first step of a construction method according to an embodiment of the present invention.

First, as shown in FIG. 1, bearing piles 1 are hammered into a ground, and a part of a base plate (base portion of an outer tank) 2 is placed thereon. The part of the base plate 2 constructed here is a ring-shaped annular portion in which sidewalls of a tank are stood.

Figure 2:
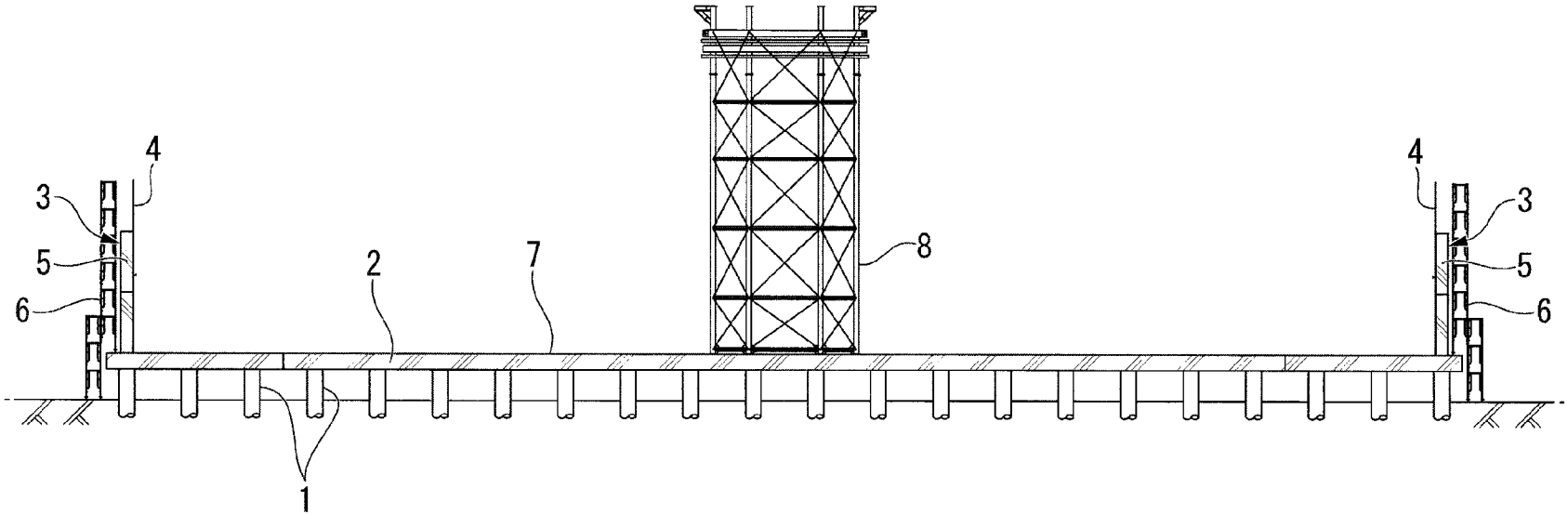
FIG. 2 is a diagram showing a second step of the construction method according to the embodiment of the present invention.

Next, as shown in FIG. 2, PC walls (the sidewalls of the outer tank) 3 are set up in the annular portion of the base plate 2 constructed earlier. To be specific, lateral liners (outer tank lateral plates) 4 are built up on the base plate 2, then concrete 5 is placed outside the lateral liners 4, and thereby the PC walls 3 are set up. The lateral liners 4 are liners made of steel, also serving as a concrete mold, and as outer scaffolds 6 are installed and the concrete 5 is placed following the building-up of the lateral liners 4, the PC walls 3 are built up in order from below.

In addition, in parallel with the process, a center portion that is on a further inward side than the annular portion of the base plate 2 is constructed, and thereby the base plate 2 is completed. After the base plate 2 is completed, a base portion liner 7 is laid thereon. Then, a roof trestle 8 is assembled at the center portion on the base plate 2.

Figure 3:
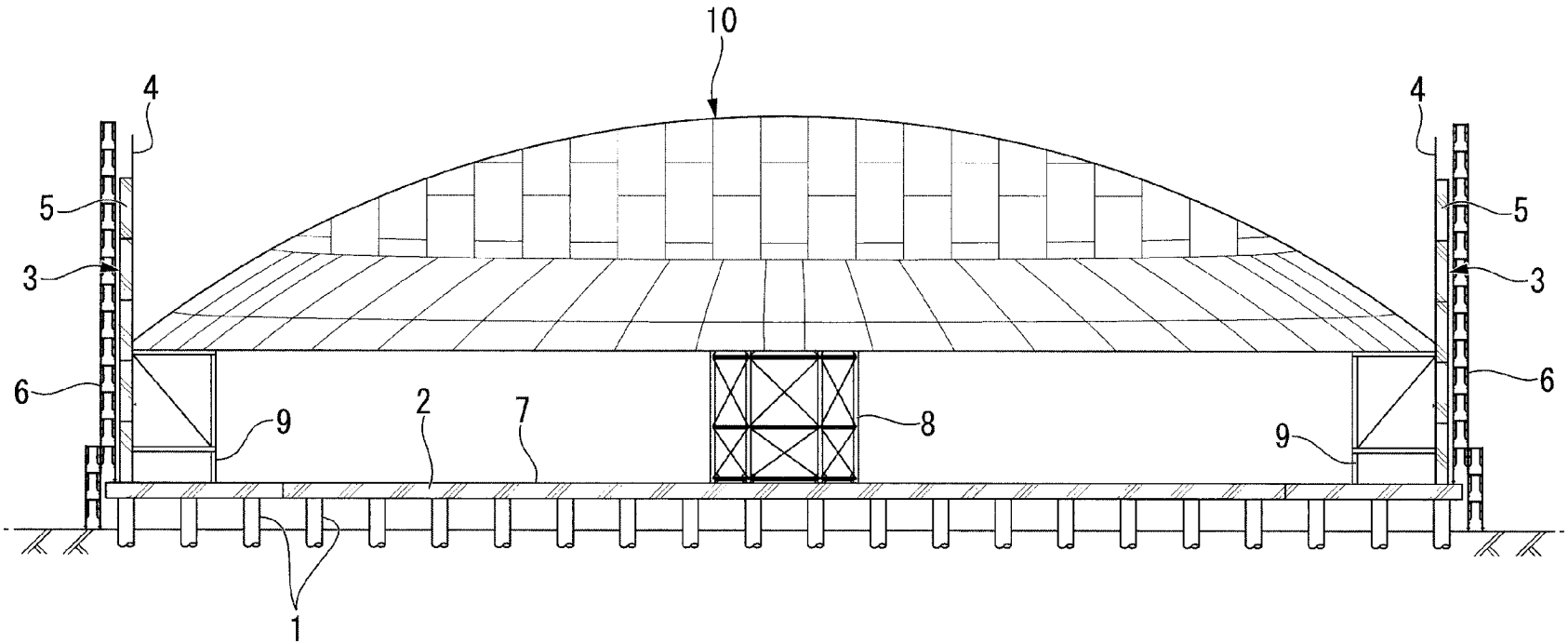
FIG. 3 is a diagram showing a third step of the construction method according to the embodiment of the present invention.

Next, a legged trestle 9 is installed along the inner side of a base end portion of the lateral liners 4 as shown in FIG. 3. Then, an outer tank roof (a roof portion of the outer tank) 10 is assembled over the roof trestle 8 and the legged trestle 9. The outer tank roof 10 is assembled by driving a tower wagon or the like onto the base plate 2 to link steel frames to each other, and then mounting roof blocks thereon. Since this outer tank roof 10 is assembled in the region other than an outer circumferential edge portion of the base plate 2 on which the PC walls 3 are built up, the building-up of the PC walls 3 and the assembly of the outer tank roof 10 do not interfere with each other, and both can be performed simultaneously.

Figure 4:
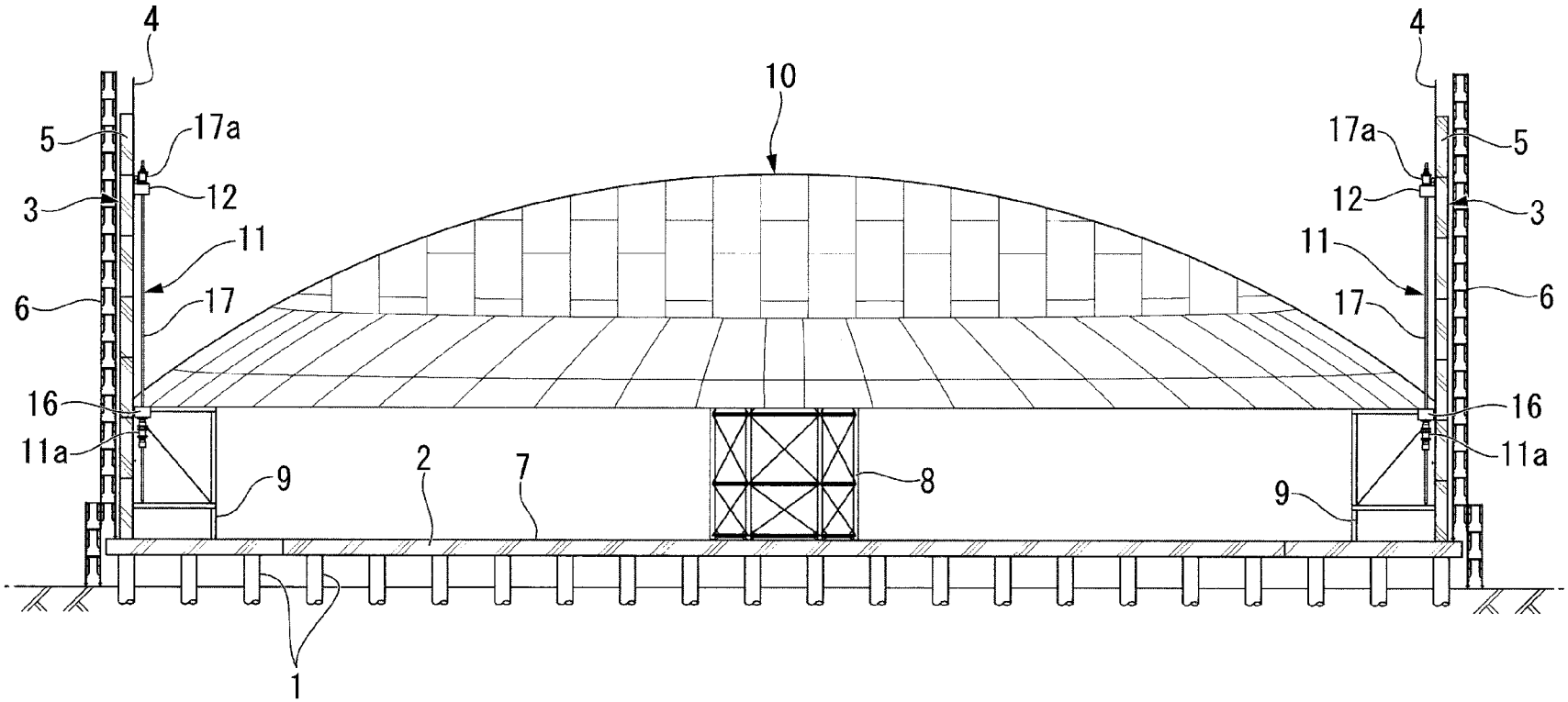
FIG. 4 is a diagram showing a fourth step of the construction method according to the embodiment of the present invention.

After the outer tank roof 10 is assembled to some degree, jack-up units 11 are then installed on the PC walls 3 that are being built up as shown in FIG. 4. First, a plurality of hanging-side jack stands (hanging points) 12 are installed in a tank circumferential direction on the PC wall 3 which is above the base plate 2 and above the outer circumferential edge portion of the outer tank roof 10. The hanging-side jack stands 12 are installed so as to protrude substantially horizontally with respect to the inner side of the tank from the PC wall 3 which is at a predetermined height. The hanging-side jack stands 12 are firmly and detachably fixed to anchor plates (anchor portions) 13 which are embedded in the PC wall 3 shown in FIG. 5

By being connected to a plurality of anchors 14 which are embedded in the concrete 5, each anchor plate 13 has more excellent strength than the lateral liner 4. The anchor plate 13 is fitted in each opening portion 15 that is formed in the lateral liner 4 in advance, and then the anchor plate 13 is installed integrally with the lateral liner 4 through fillet welding or the like. In other words, proper positions of the lateral liner 4 are partially constituted with the anchor plate 13, and the hanging-side jack stand 12 is fixed to the anchor plate 13.

Note that, in order to support the jack-up unit 11 by providing the hanging-side jack stand 12 on the PC wall 3, it is also possible to secure strength to bear the jack-up unit 11 by increasing the entire plate thickness of the lateral liner 4; however, it hinders reduction of the weight and costs which are attained by optimum design of the lateral liner 4. For this reason, in the present embodiment, using the anchor plate 13 which is attached to the opening portion 15 of the lateral liner 4 and accordingly has increased support strength in parts, the hanging-side jack stand 12 is fixed and the jack-up unit 11 is supported.

With the presence of the anchor plate 13 as described above, it is not necessary to secure the strength to bear the jack-up unit 11 by thickening the entire plate thickness of the lateral liner 4 or the like, and a necessary anchor point can be secured while maintaining the plate thickness of the lateral liner 4 at a requisite minimum level.

Returning to FIG. 4, a plurality of hanged-side jack stands 16 corresponding to each of the plurality of hanging-side jack stands 12 are next installed in the outer circumferential edge portion of the outer tank roof 10. The hanged-side jack stands 16 are installed so as to protrude substantially horizontally with respect to an outer side of the tank from the outer circumferential edge portion of the outer tank roof 10. The hanged-side jack stands 16 are detachably fixed to the outer circumferential edge portion of the outer tank roof 10.

Note that the hanged-side jack stands 16 may be installed in an upper portion of the outer tank roof 10 rather than the side portion of the outer tank roof 10 as shown in FIG. 4.

Then, each jack-up unit 11 is installed across the hanging-side jack stand 12 and the hanged-side jack stand 16. The jack-up unit 11 is configured as a center hole jack as shown in FIG. 4, and has a cylindrical jack main body 11*a* that is hung on the lower side of the hanged-side jack stand 16, and a jack-up rod 17 that extends upward and downward to be held by the jack main body 11*a* so as to make strokes and has an upper end portion that is engaged with the hanging-side jack stand 12 via an equalizer 17*a*.

The plurality of jack-up units 11 with the above-described configuration are installed at a predetermined interval in the tank circumferential direction. Note that the roof trestle 8 can be removed after the roof steel frame portion of the outer tank roof 10 is built up, and a part of the legged trestle 9 can be removed after the jack-up units 11 are installed as described above. After a part of the roof trestle 8 and the legged trestle 9 are removed, the outer tank roof 10 is in the state in which the weight thereof is borne by the plurality of jack-up units 11.

Figure 6:
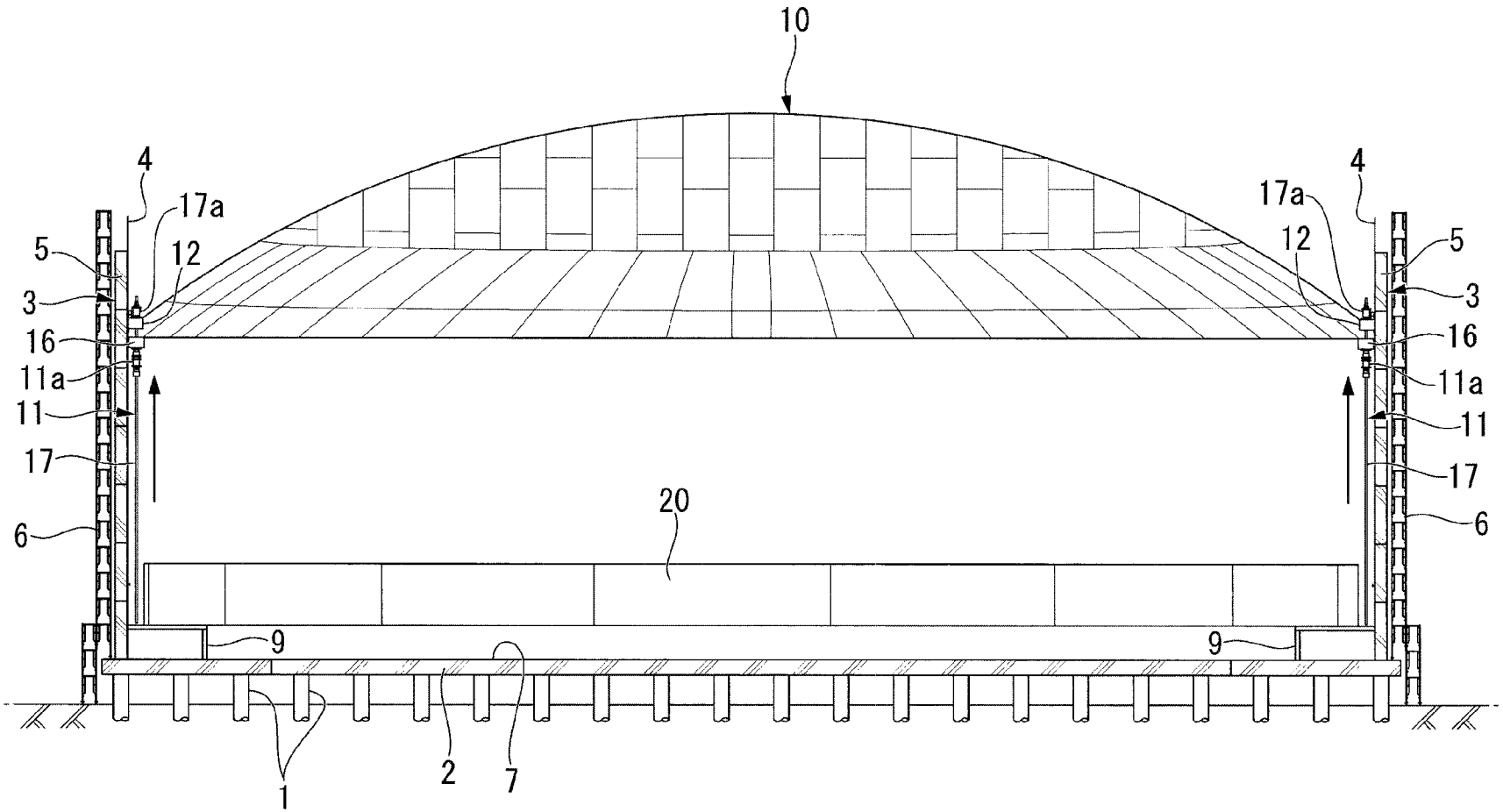
FIG. 6 is a diagram showing a fifth step of the construction method according to the embodiment of the present invention.

Next, as shown in FIG. 6, the outer tank roof 10 that has been assembled on the base plate 2 is lifted by the jack-up units 11. To be specific, when the jack main body 11*a* is driven to rotate normally, the jack main body 11*a* is lifted along the jack-up rod 17 together with the hanged-side jack stand 16, and accordingly the outer tank roof 10 that is being assembled is jacked up. By jacking up the outer tank roof 10, inner tank lateral plates 20 are carried in under the outer tank roof 10, and thereby a work space for assembling an inner tank can be secured.

By lifting the outer tank roof 10 using the jack-up units 11 as described above, the outer tank roof 10 can be lifted more easily than in the air-raising technique. In other words, since the outer tank roof 10 is lifted using air pressure in the air-raising technique, the outer tank roof 10 should be assembled to the extent that is no air leakage therefrom, and thus it is not possible to lift the outer tank roof 10 halfway unlike in the present embodiment. Further, it is necessary in the air-raising technique to install a blower or the like for blowing air, and to assemble the PC walls 3 and the inner tank lateral plates 20 beforehand.

Figure 5:
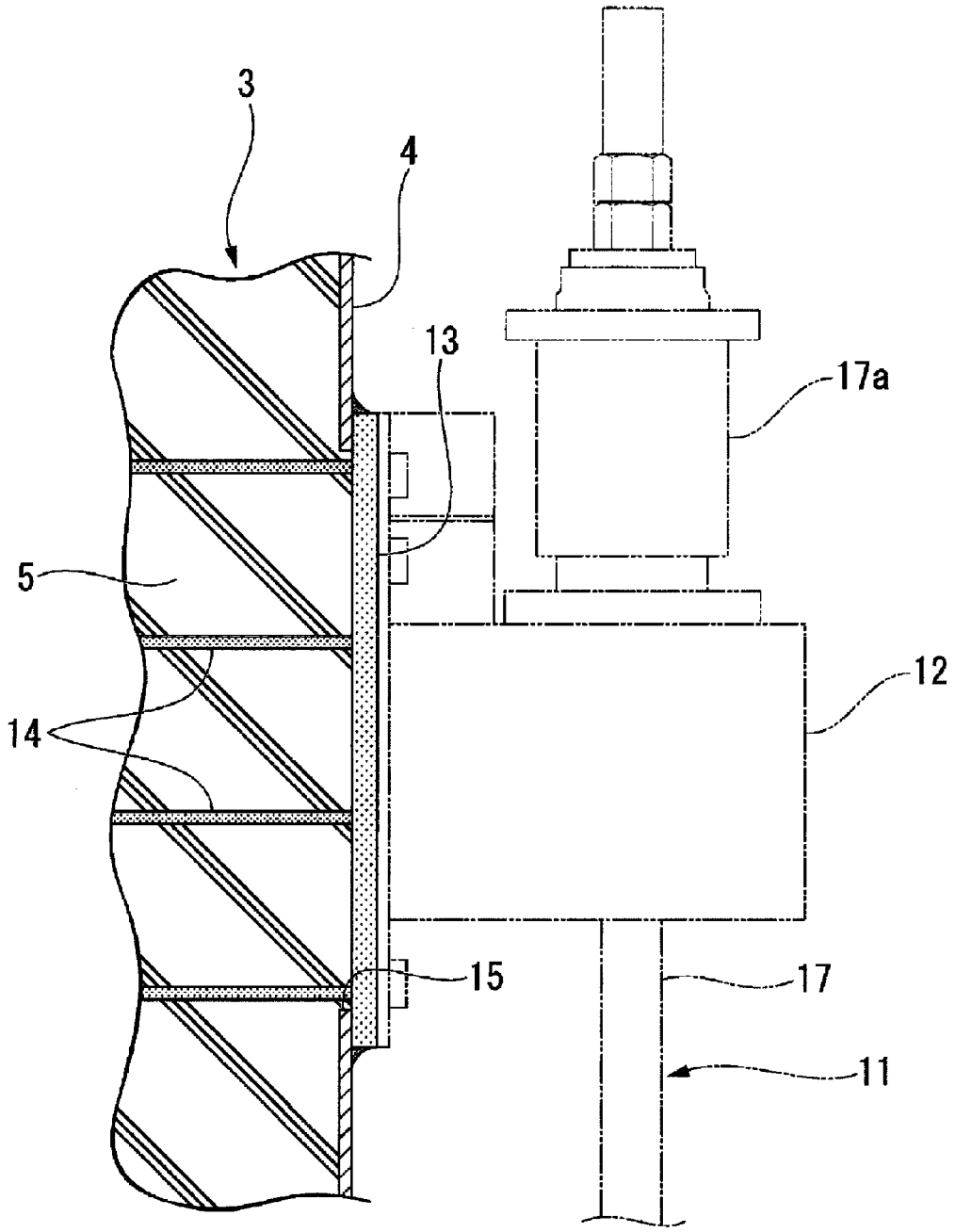
FIG. 5 is a cross-sectional diagram showing a configuration of an anchor plate according to the embodiment of the present invention.
Figure 7:
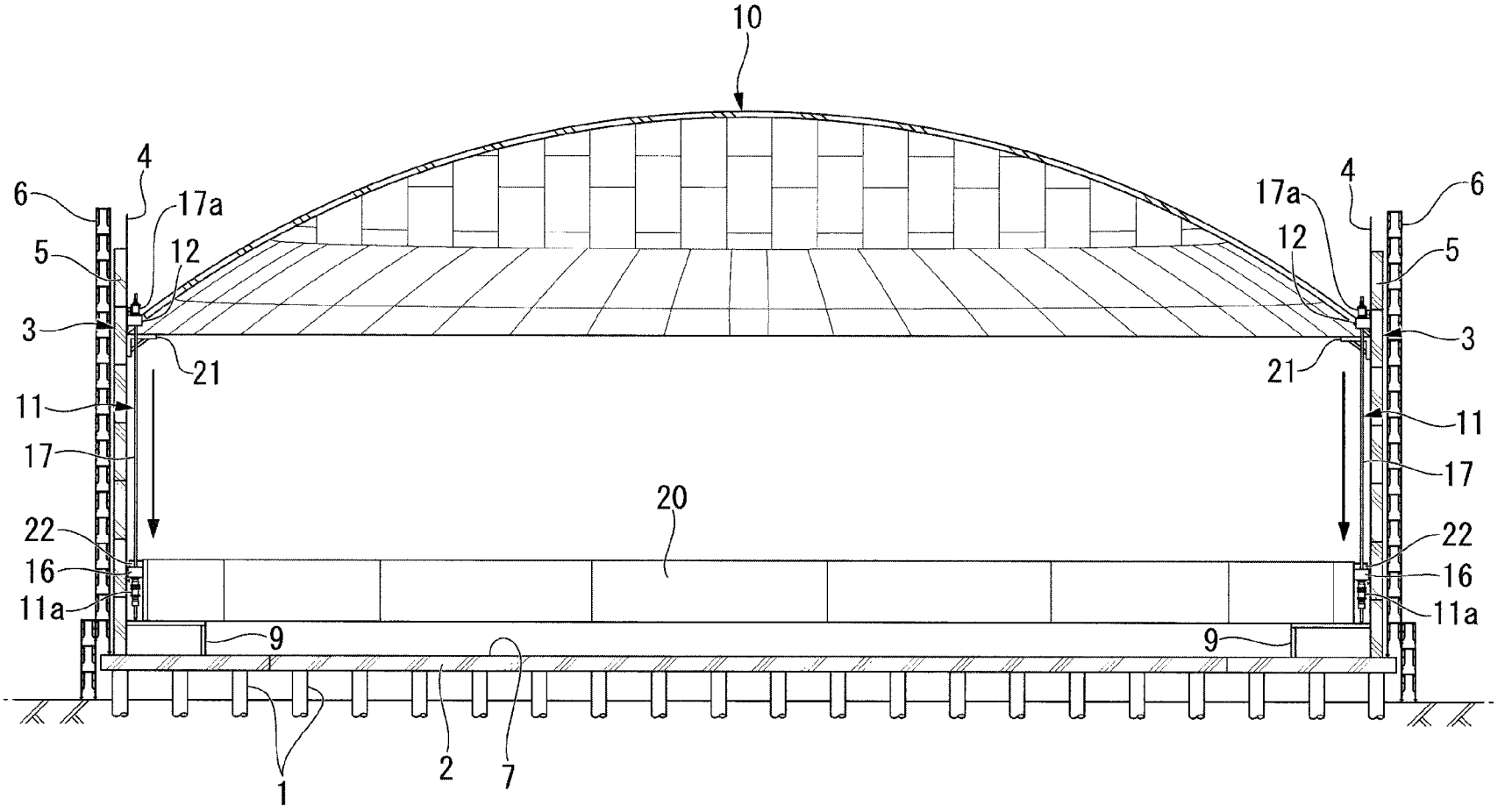
FIG. 7 is a diagram showing a sixth step of the construction method according to the embodiment of the present invention.

Next, the outer tank roof 10 that has been lifted using the jack-up units 11 is held on the PC walls 3 as shown in FIG. 7. To be specific, the outer tank roof 10 is held on the PC walls 3 using holding stands 21 that are installed in the middle level of the PC walls 3. The holding stands 21 are installed so as to protrude substantially horizontally with respect to the inner side of the tank from the PC walls 3 that are at a predetermined height. The holding stands 21 are firmly and detachably fixed to, for example, the anchor plates 13 that are embedded in the PC walls 3 as shown in FIG. 5.

After the holding stands 21 are installed, the fixation of the hanged-side jack stands 16 to the outer tank roof 10 is released. After the fixation of the hanged-side jack stands 16 is released, the outer tank roof 10 is in the state in which the weight thereof is borne by the holding stands 21. When the outer tank roof 10 is held on the PC walls 3 via the holding stands 21 as described above, the jack main body 11*a* is driven to rotate in reverse, and accordingly lowered close to the base plate 2. Then, the space under the outer tank roof 10 can be used for the assembly work of the inner tank lateral plates 20. Note that hanged-side jack stands 16 are separately attached to the inner tank lateral plates 20; however, the hanged-side jack stands 16 of the outer tank roof 10 may be diverted thereto.

At the time of assembling the inner tank, the plurality of inner tank lateral plates (which are also sidewalls of the inner tank) 20 are first stood on the legged trestle 9 in the tank circumferential direction as shown in FIG. 7. Then, by welding the inner tank lateral plates 20 which are adjacent to each other in the lateral direction to be integrated, the respective inner tank lateral plates 20 are assembled in a circular shape. Note that the inner tank lateral plates 20 assembled here correspond to the uppermost level (eighth level in the present embodiment).

Next, a plurality of hanged-side attachment cradles 22 corresponding to each of the plurality of hanged-side jack stands 16 are installed on the inner tank lateral plates 20 that are assembled in the circular shape. The hanged-side attachment cradles 22 are installed so as to protrude substantially horizontally with respect to the outward side of the tank from the outer circumferential faces of the inner tank lateral plates 20 that are assembled in the circular shape. The hanged-side jack stands 16 of the jack-up units 11 are detachably fixed to the hanged-side attachment cradles 22. Accordingly, the inner tank lateral plates 20 that are assembled in the circular shape are in the state in which all or a part of the weight thereof is borne by the jack-up units 11. In addition, it is preferable to use an appropriate supporting material for at least one of the inner and outer sides of the inner tank lateral plates 20 in order to prevent deformation of the inner tank lateral plates 20, if necessary.

Figure 8:
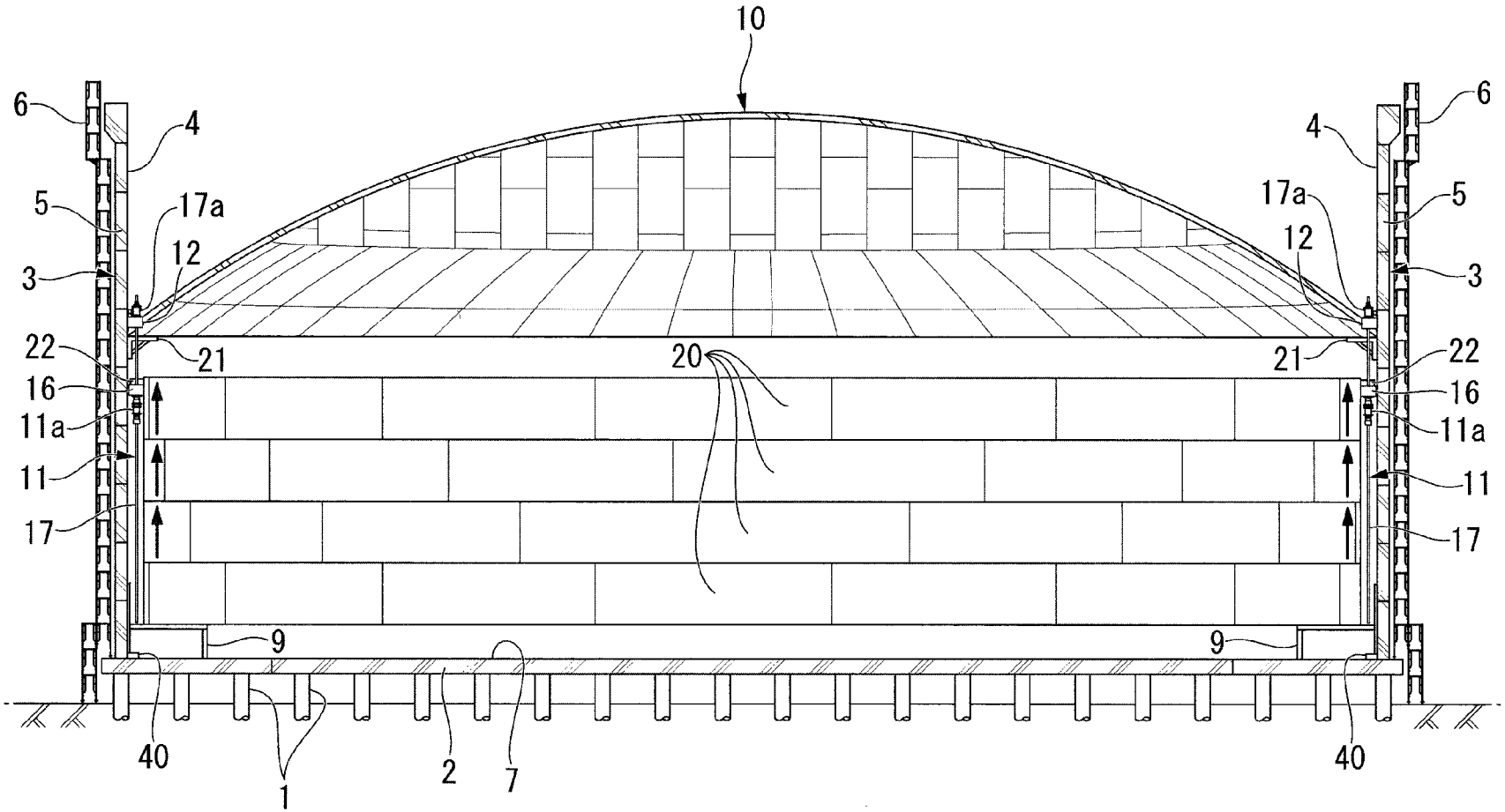
FIG. 8 is a diagram showing a seventh step of the construction method according to the embodiment of the present invention.

Next, the inner tank is assembled as shown in FIG. 8 by alternately repeating lifting of the inner tank lateral plates 20 using the jack-up units 11 and attachment of the next inner tank lateral plates to the lower side of the lifted inner tank lateral plates 20. To be specific, by first performing jack-up of the jack-up units 11, the inner tank lateral plates 20 assembled in the circular shape are lifted just as much as the vertical width of the single inner tank lateral plate 20. Next, the next inner tank lateral plate 20 is carried in a space formed in a lower portion of the inner tank lateral plates 20 due to the jack-up through a construction site entrance that is provided in the PC wall 3 but is not shown, and the inner tank lateral plate 20 is put down on the legged trestle 9 and then disposed in the circular shape beneath the jacked up inner tank lateral plates 20.

Then, the plurality of inner tank lateral plates 20 disposed in the circular shape are welded to each other, the inner tank lateral plates 20 arranged on the upper and lower sides are welded together, and accordingly, the inner tank lateral plates 20 are integrally formed in a cylindrical shape.

Note that it may be possible for the plurality of inner tank lateral plates 20 to be coupled with each other in the lateral direction outside the tank in advance, the coupled plates are carried inside the tank and formed to the circular shape, and then the inner tank lateral plates 20 arranged on the upper and lower sides are welded together. By coupling the plurality of inner tank lateral plates 20 in the outside of the PC wall 3 in which there is little restriction on a work space as described above, the welding work becomes easy and the inner tank can be efficiently assembled.

In addition, by alternately repeating the lifting of the inner tank lateral plates 20 using the jack-up units 11 and the attachment of the next inner tank lateral plate 20 to the lower side of the lifted inner tank lateral plates 20 as described above to continuously add the next inner tank lateral plates 20 to the lower side of the inner tank lateral plates 20, the addition of the inner tank lateral plates 20 is performed at a low position close to the base plate 2. For this reason, the assembly work of the inner tank is safely possible at the low position while interference with the outer tank roof 10 that is held in the middle level of the PC walls 3 is avoided.

During these steps, the outer tank roof 10 that is held on the PC walls 3 and being assembled is assembled. To be specific, before the outer tank roof 10 is finally mounted on the top portion of the PC walls 3, the outer tank roof 10 is assembled almost completely, including bar reinforcement work for placing roof concrete in the state in which the outer tank roof is held in the middle level of the PC walls 3. In the present embodiment, since the mounting of the outer tank roof 10 onto the top portion of the PC walls 3 is performed via a coupler to be described later, the bar reinforcement work is started when the outer tank roof 10 is at a middle point. Accordingly, in the present embodiment, after the building-up of the PC walls 3 is completed, the outer tank roof 10 is mounted onto the top portion thereof, and thus the outer tank can be quickly completed.

In the present technique, the PC walls 3 are built up in the outer circumferential edge portion of the base plate 2 as described above, and the outer tank roof 10 is assembled in parallel therewith on the base plate 2 other than the outer circumferential edge portion. Thus, when the outer tank roof 10 is assembled to some degree, the outer tank roof 10 is lifted using the jack-up units 11, and then is held by the PC walls 3 that are being built up. Accordingly, the space in which the inner tank is assembled can be secured under the outer tank roof 10, and thus the inner tank can be assembled independently of the outer tank roof 10. Therefore, according to the present embodiment, the building up of the PC walls 3, the assembly of the outer tank roof 10, and the assembly of the inner tank can be performed simultaneously, and thus the construction period can be greatly shortened.

In addition, at the same time, a thermal corner protection 40 for preventing leakage of tank content can be provided in the annular portion that is between the inner and outer tanks in the present technique as shown in FIG. 8. The thermal corner protection 40 is constructed in a space on the lower side of the legged trestle 9 using foam glass, perlite concrete blocks, or the like. Note that the thermal corner protection 40 is a member that protects corners; however, it is also continuously constructed on the inner side along the top of the base plate 2 in addition to the corners.

Figure 9:
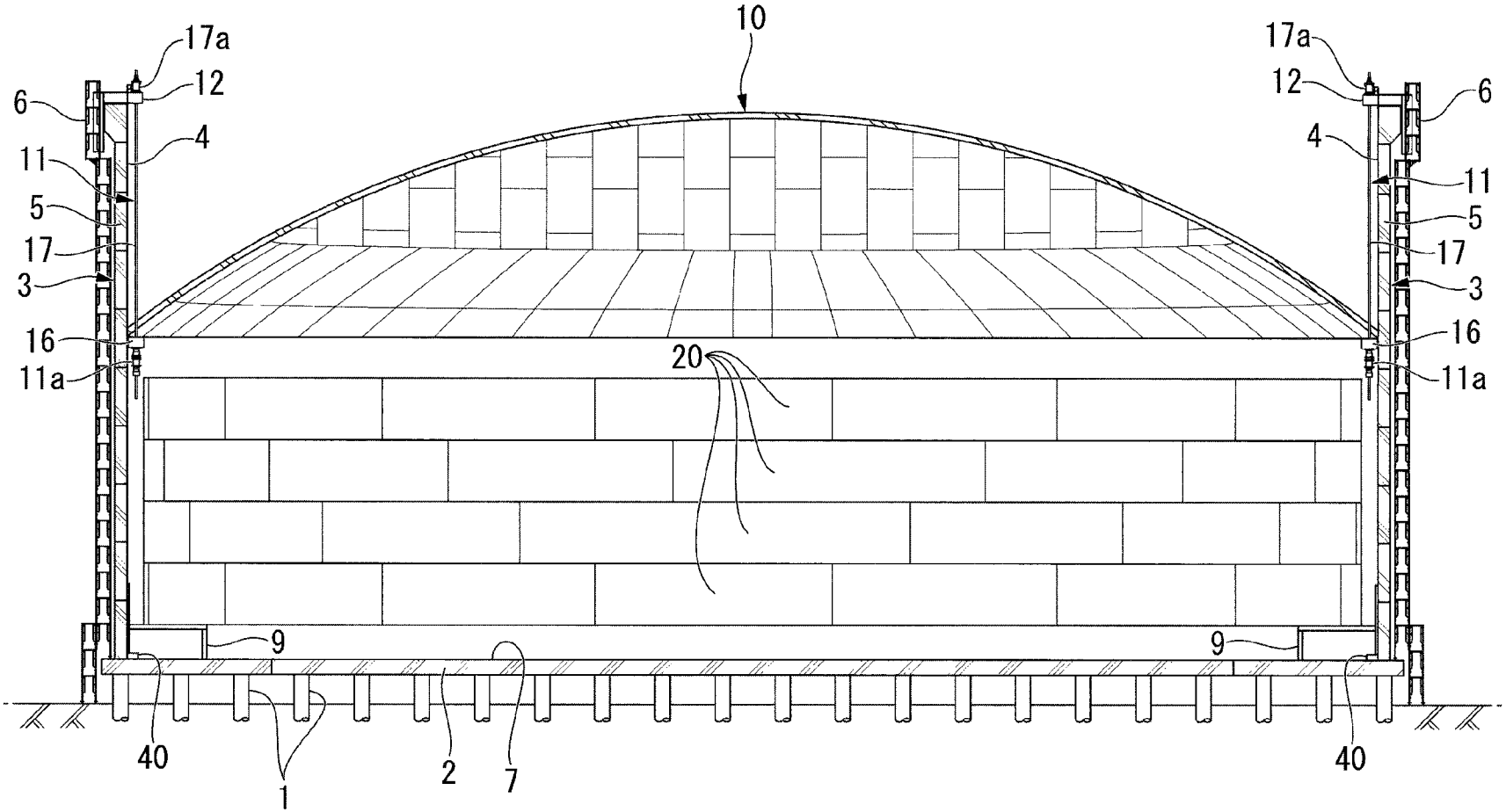
FIG. 9 is a diagram showing an eighth step of the construction method according to the embodiment of the present invention.

After the building-up of the PC walls 3 is completed, the jack-up units 11 are next provided at the top portion of the PC walls 3 as shown in FIG. 9. To be specific, fixation of the hanging-side jack stand 12 to the middle level of the PC wall 3 is released, the hanging-side jack stand 12 is fixed to a top portion of the PC walls 3 via a provisional trestle, the fixation of the hanged-side jack stands 16 to the inner tank lateral plates 20 is released, and the hanged-side jack stands 16 are fixed to the outer circumferential edge portion of the outer tank roof 10. Then, the jack-up units 11 are installed across the hanging-side jack stands 12 and the hanged-side jack stands 16. After the jack-up units 11 are installed as described above, the holding stands 21 can be removed, and thus the holding stands 21 are then removed at a proper timing.

Figure 10:
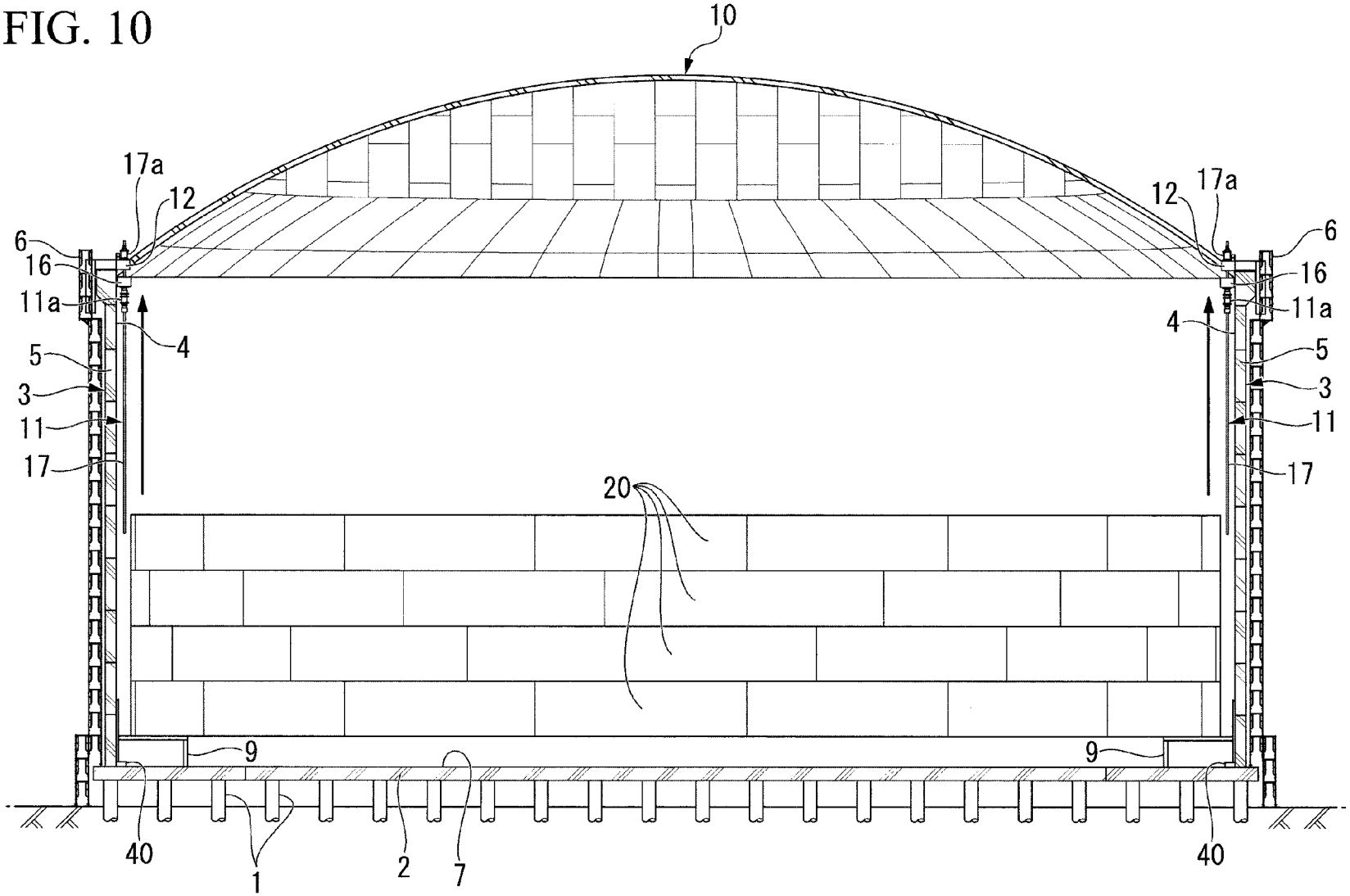
FIG. 10 is a diagram showing a ninth step of the construction method according to the embodiment of the present invention.
Figure 11A:
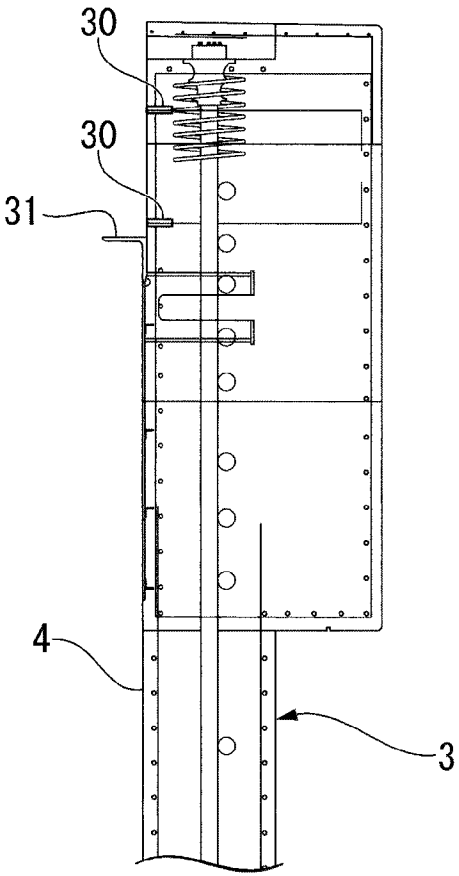
FIG. 11A is a cross-sectional diagram showing a structure of a coupler according to the embodiment of the present invention.
Figure 11B:
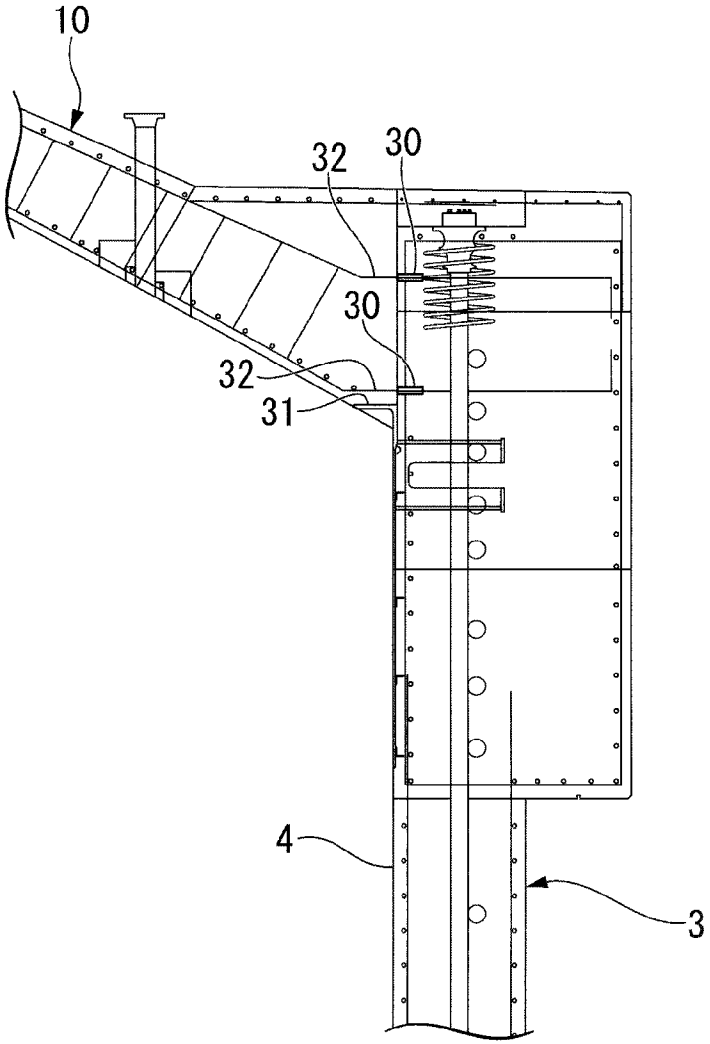
FIG. 11B is a cross-sectional diagram showing a structure of connection using the coupler according to the embodiment of the present invention.

Next, the outer tank roof 10 is lifted using the jack-up units 11 and mounted on the top portion of the PC walls 3 as shown in FIG. 10. If the jack-up units 11 for pulling up the outer tank roof 10 which is held in the middle level of the PC walls 3 are provided on side portions of the PC walls 3, it is not possible to mount a concrete portion of the outer tank roof 10 at the locations of the jack-up units 11. For this reason, the jack-up units 11 are provided at the top portion of the PC walls 3, couplers 30 are provided on inner circumferential faces of the PC walls 3 as shown in FIGS. 11A and 11B in the present technique, and accordingly, the concrete portion of the outer tank roof 10 is mounted on the couplers 30. Note that the placed concrete 5 is not shown in FIGS. 11A and 11B.

FIG. 11A shows the state before the outer tank roof 10 is mounted. The periphery of the top portion of the PC wall 3 is configured as shown in FIG. 11A, and a portion assembled as a part of a structure of the lateral liner 4 beforehand is mounted at an upper end of the wall. Angles (projecting portions) 31 are provided on the inner circumferential face of the PC walls 3. Each angle 31 is installed so as to protrude substantially horizontally with respect to the inner side of the tank from the PC wall 3 which is at a predetermined height. A plurality of the couplers 30 are provided above the angles 31 to connect reinforcing bars 32 of the outer tank roof 10 to the inner circumferential face of the PC walls 3.

FIG. 11B shows the state after the outer tank roof 10 is mounted. In mounting of the outer tank roof 10, a height at which the outer tank roof 10 is to be lifted is first regulated by the angles 31 provided on the inner circumferential face of the PC walls 3. In other words, a part of the structure of the outer circumferential edge portion of the jacked-up outer tank roof 10 is ed by the angles 31 protruding to the inner side of the tank from the PC walls 3, and thus the height of the outer tank roof 10 is regulated. Then, the outer tank roof 10 is fixed at the locked position through welding or the like, and then the outer tank roof 10 is mounted at the predetermined position. Then, among the reinforcing bars 32 spread on the outer tank roof 10, remaining ones are connected to the couplers 30 when the outer tank roof 10 is at the middle position in advance, thereby preparing for placement of the concrete portion of the outer tank roof 10.

With the connection structure using the couplers 30 as described above, the bar reinforcement work on the outer tank roof 10 is started in the state in which the roof is held in the middle level of the PC walls 3 as shown in FIGS. 7 and 8, and after building-up of the PC walls 3 is completed, the reinforcing bars 32 of the outer tank roof 10 are connected to the couplers 30, and then the outer tank roof 10 can be quickly mounted on the top portion of the PC walls 3. In other words, with the connection structure using the couplers 30, the bar reinforcement work can be started when the outer tank roof 10 is in the middle position, independently of the bar reinforcement work performed above the outer tank roof 10. As a result, a start time of on-roof framework that will be described later is inevitably advanced.

Figure 12:
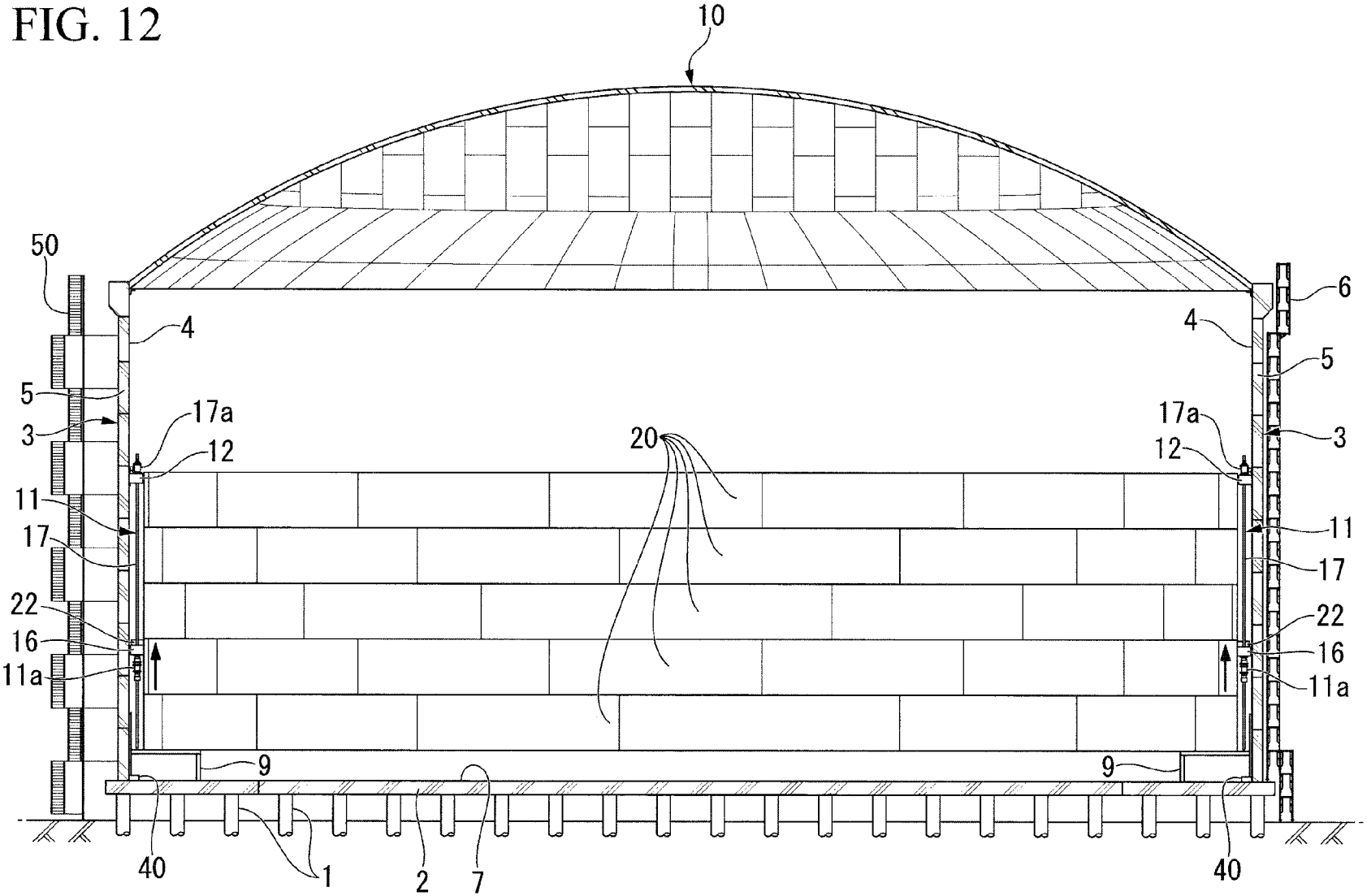
FIG. 12 is a diagram showing a tenth step of the construction method according to the embodiment of the present invention.

After the outer tank roof 10 is mounted on the PC walls 3, the jack-up units 11 are next provided in the middle level of the PC walls 3 as shown in FIG. 12. Then, the inner tank is assembled to the end using the jack-up units 11. In other words, by alternately repeating the lifting of the inner tank lateral plate 20 using the jack-up units 11 and attachment of the next inner tank lateral plate 20 to the lower side of the lifted inner tank lateral plate 20 as described above, the inner tank lateral plates 20 are assembled from the uppermost level to the lowermost level (a total of 8 levels in the present embodiment).

Figure 13:
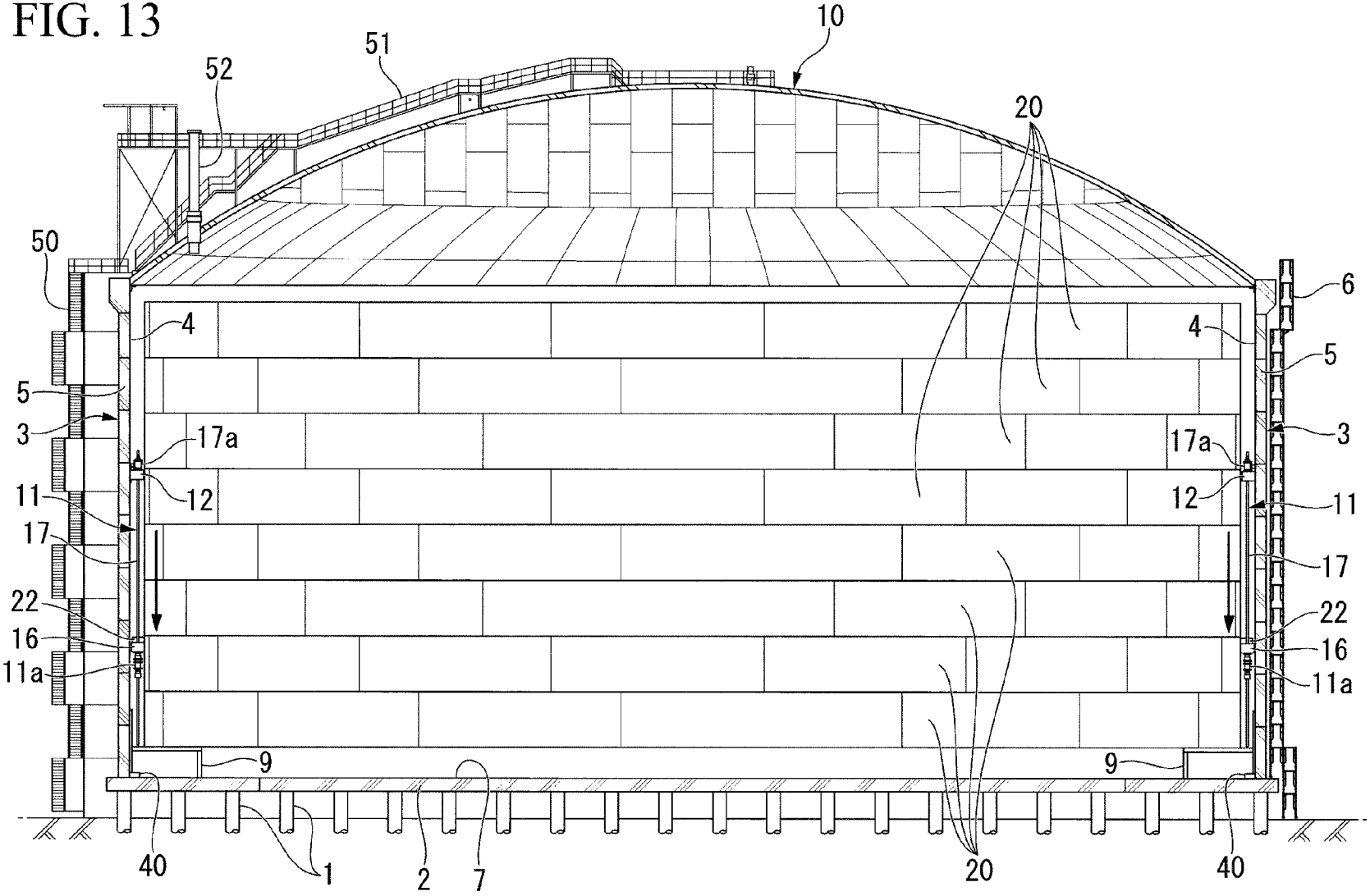
FIG. 13 is a diagram showing an eleventh step of the construction method according to the embodiment of the present invention.

After the inner tank is assembled to the end as shown in FIG. 13, the inner tank is put down on the base plate 2 at a predetermined position.

Note that connection positions of the hanged-side jack stands 16 with respect to the inner tank lateral plates 20 may be changed downward. This is so that the inner tank on the base plate 2 can be put down precisely at the predetermined position in the following step. In addition, the inner tank lateral plates 20 on the lower level side have a thick plate thickness in response to relatively high fluid pressure of a content fluid after the completion of the tank, but the inner tank lateral plates 20 on the upper level side (particularly, in the uppermost level) have a thin plate thickness in response to relatively low fluid pressure of the content fluid, and thus connecting the hanged-side jack stands 16 to the lower side of the inner tank lateral plates 20 is favorable in terms of strength.

Figure 14:
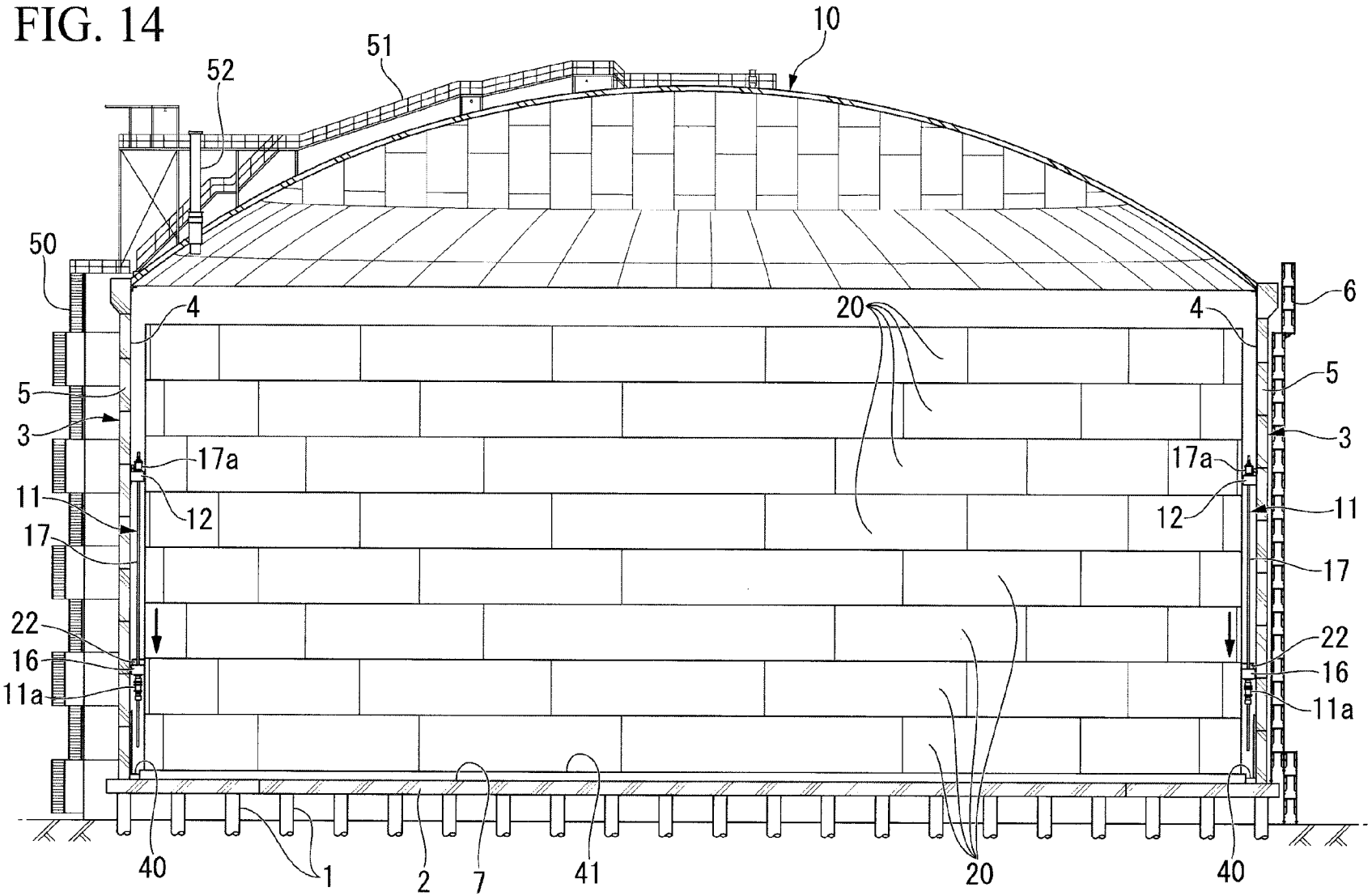
FIG. 14 is a diagram showing a twelfth step of the construction method according to the embodiment of the present invention.

Next, the legged trestle 9 is removed, and cold insulation work of laying a cold insulation material 41 on the base plate 2 is performed as shown in FIG. 14. The cold insulation material 41 is formed by, for example, providing foam glass on a base-portion cold resistance relaxation material laid on the base plate 2, providing toughened lightweight aerated concrete, perlite concrete blocks, lightweight concrete blocks for a structure, and the like in the portion in which the inner tank is put down, and laying the inner tank basal plates thereon. After the cold insulation work on the base plate 2 is finished, the inner tank is put down on the base plate 2 by the jack-up units 11. After the inner tank is put down, the jack-up units 11 are removed.

In addition, elevation stairs 50 are provided along the PC walls 3, the on-roof framework 51, a barrel nozzle 52, and the like are provided on the outer tank roof 10, and concrete is placed in the outer tank roof 10. Note that concrete placing may be performed immediately after the reinforcing bars 32 on the outer tank roof 10 are connected to the couplers 30 in order to perform a framework operation on the outer tank roof 10.

Then, tension work of the PC walls 3 is performed. In addition, after a pump barrel 53 is installed and the construction site entrance to the inner tank that is not shown is closed, the tank is filled with water to perform pressure resistance and air-tightness tests. Note that the installation of the pump barrel 53 is normally performed before the construction site entrance to the inner tank that is not shown is closed, but the installation time can be arbitrarily set.

Figure 15:
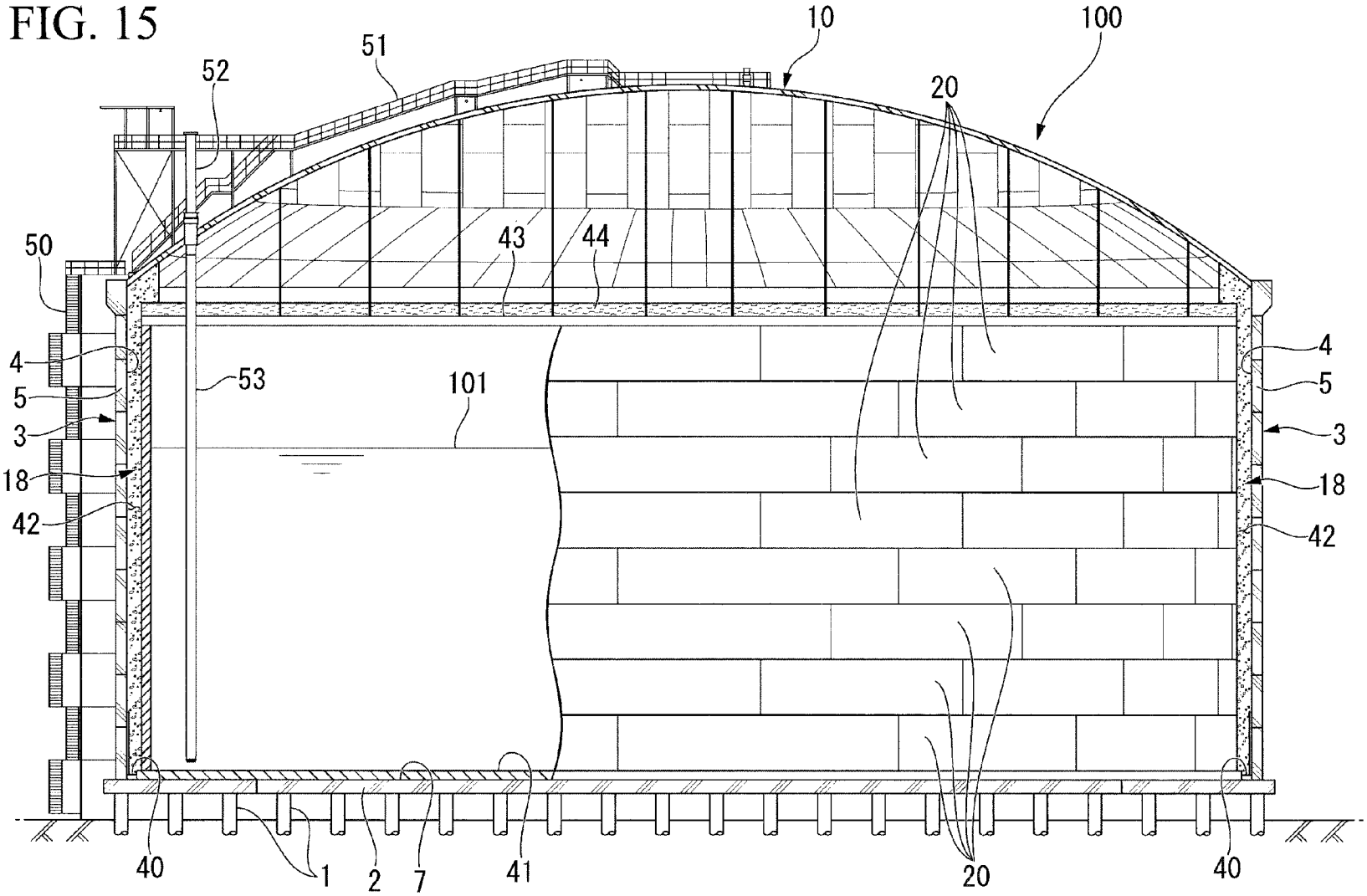
FIG. 15 is a diagram showing a thirteenth step of the construction method according to the embodiment of the present invention.

Finally, as shown in FIG. 15, an inner-outer-tank gap 18 is filled with a cold insulation material 42 (for example, perlite) to perform cold insulation work for the inner-outer-tank gap, and a cold insulation material 44 (for example, glass wool) is laid on a suspension deck 43 that is provided in the underside of the outer tank roof 10, and thereby roof underside cold insulation work is performed.

Then, painting work and cold insulation piping work are performed, and thereby construction of a cylindrical tank 100 that contains LNG 101 is completed.

As described above, the method for constructing the cylindrical tank 100 which has a metallic inner tank and a concrete outer tank in the present embodiment described above has the step of building up the PC walls 3 in the outer circumferential edge portion of the base plate 2, the step of assembling the outer tank roof 10 on the base plate 2 other than the outer circumferential edge portion of the base plate 2, the step of lifting the outer tank roof 10 which is on the base plate 2 using the jack-up units 11 while the PC walls 3 are being built up and then holding the outer tank roof on the PC wall 3, and the step of assembling the inner tank independently of the outer tank roof 10 in the space under the outer tank roof 10 which is created due to the lifting. For this reason, the building-up of the PC walls 3, the assembly of the outer tank roof 10, and the assembly of the inner tank can be worked simultaneously, which enables the construction period to be greatly shortened. Therefore, according to the present embodiment, the method for constructing the cylindrical tank 100 which can greatly shorten the construction period is obtained.

In addition, in the present embodiment, as the step of assembling the outer tank roof 10 in the state in which the outer tank roof is held on the PC walls 3 is adopted, by completing the building-up of the PC walls 3 and then mounting the outer tank roof 10 on the top portion thereof, the outer tank can be completed quickly.

In addition, in the present embodiment, by alternately repeating the lifting of the inner tank lateral plates 20 using the jack-up units 11 and attachment of the next inner tank lateral plates 20 to the lower side of the limited inner tank lateral plates 20, the continuous addition of the inner tank lateral plates 20 is performed at the low position as the step of assembling the inner tank is adopted, and thus while interference with the outer tank roof 10 held in the middle level of the PC walls 3 is avoided, the work of assembling the inner tank can be safely performed at the low position.

In addition, in the present embodiment, the PC walls 3 are built up by placing concrete using the lateral liners 4 as inner side molds. In addition, as the step of forming each opening portion 15 in the lateral liners 4 in advance, the step of fitting each anchor plate 13, which is connected to the anchor 14 that is embedded in concrete, in the opening portion 15, and the step of supporting the jack-up units 11 via the anchor plate 13 which is fitted in the opening portion 15 are adopted, it is not necessary to secure strength to bear the jack-up units 11 by thickening the plate thickness of each lateral liner 4, or the like, and a necessary anchor point can be secured while maintaining the plate thickness of the lateral liner 4 at a requisite minimum level.

In addition, in the present embodiment, as the step of providing the jack-up units 11 at the top portion of the PC walls 3 after the PC walls 3 are built up to lift the outer tank roof 10, the step of providing angles 31 on the inner circumferential face of the PC walls 3 to regulate the height at which the outer tank roof 10 is lifted, and the step of attaching the outer tank roof 10 whose height is regulated by the angles 31 to the inner circumferential face of the PC walls 3 via the couplers 30 are employed, the bar reinforcement work on the outer tank roof 10 which is held in the middle level of the PC walls 3 is started, and after the building-up of the PC walls 3 is completed, the outer tank roof 10 can be quickly mounted on the inner circumferential face of the PC walls 3 via the couplers 30.

Hereinabove, although the exemplary embodiment of the present invention has been described with reference to the drawings, the present invention is not limited to the embodiment. All shapes, combinations, and the like of the respective constituent members shown in the above-described embodiment are examples, and various modifications can be made based on design requirements, and the like within a scope not departing from the gist of the present invention.

For example, the building-up of the PC walls 3, the assembly of the outer tank roof 10, and the assembly of the inner tank have been described as being worked simultaneously in the above-described embodiment; however, since a work space can be secured above the base plate 2 due to the legged trestle 9, the cold insulation work for the base portion on the base plate 2 may also be performed simultaneously.

In addition, for example, the technique of hoisting the outer tank roof 10 using the jack-up units 11 has been described in the above-described embodiment; however, for example, a type of the jack-up units 11 used to push the outer tank roof 10 up may be changed. With this configuration, the jack-up units 11 may not be installed at the top portion of the PC walls 3 when the outer tank roof 10 is mounted on the PC walls 3, unlike in the above-described embodiment, and thus a structure of the related art can be adopted, without adopting the connection structure that uses couplers.

In addition, for example, the technique of hoisting the outer tank roof 10 using the jack-up units 11 has been described in the above-described embodiment; however, a type of the jack-up units 11 is not limited to this form, and for example, the positional relation between the jack main body 11*a* and the equalizer 17*a* may be turned upside down.

In addition, for example, the technique of hoisting the inner tank lateral plates 20 using the jack-up units 11 has been described in the above-described embodiment; however, a type of the jack-up units 11 may be changed to push the inner tank lateral plates 20 up. With this configuration, by preparing one set of the jack-up units 11 for hoisting the outer tank roof 10 and diverting the jack-up units for constructing a plurality of cylindrical tanks 100, the number of necessary jack-up units 11 can be reduced.

In addition, for example, the outer tank roof 10 has been described as being jacked up to be held in the middle level of the PC walls 3 during assembly in the above-described embodiment; however, the suspension deck 43, the on-roof framework 51, the barrel nozzle 52, and the like may be assembled on the base plate 2, and then the outer tank roof 10 that is almost completed may be jacked up to be held in the middle level of the PC walls 3. In this case, it is necessary to take into account the influence of deformation of the steel frame portion of the outer tank roof 10 on the on-roof framework 51 relating to concrete placement of the outer tank roof 10.

In addition, for example, the provision of the jack-up units 11 to support the outer tank roof 10 and the like via the anchor plates 13 has been described in the above-described embodiment; however, depending on the weight of a load to bear, for example, by driving additional concrete studs into the lateral liners 4 to cause supports having stays and the like to bear the load of the outer tank roof 10 and the like without providing the opening portions 15, it is possible to secure sufficient reaction force for supporting the outer tank roof 10 and the like.

In addition, for example, the jack-up units 11 are shared for jack-up of the outer tank roof 10 and jack-up of the inner tank lateral plates 20 in the above-described embodiment; however, respective dedicated jack-up units may be used. Note that, when dedicated jack-up units are used, it is almost unnecessary to change installation positions of the jack-up units, unlike in the above-described embodiment; however, the number of the units increases, and thus it is favorable to select any preferable manner according to a scale of the cylindrical tank 100 to be constructed.

INDUSTRIAL APPLICABILITY

According to the present invention, the method for constructing a cylindrical tank that can shorten a construction period is obtained.

REFERENCE SIGNS LIST

2 Base plate (base portion of outer tank)
3 PC wall (sidewall of outer tank)
4 Lateral liner (outer tank lateral plate)
5 Concrete
10 Outer tank roof (roof portion of outer tank)
11 Jack-up unit
13 Anchor plate (anchor portion)

14 Anchor
15 Opening portion
20 Inner tank lateral plate
30 Coupler
31 Angle (protruding portion)
100 Cylindrical tank

The invention claimed is:

1. A method for constructing a cylindrical tank which has a metallic inner tank and a concrete outer tank, comprising:

a step of building up a sidewall of the concrete outer tank in an outer circumferential edge portion of a base portion of the concrete outer tank;

a step of assembling a roof portion of the concrete outer tank on the base portion of the concrete outer tank other than the outer circumferential edge portion;

a step of lifting the roof portion of the concrete outer tank which is on the base portion of the concrete outer tank using a jack-up unit while the sidewall of the concrete outer tank is being built up and then holding the roof portion on the sidewall of the concrete outer tank; and a step of assembling the metallic inner tank independently of the roof portion of the concrete outer tank in a space under the roof portion of the concrete outer tank which is created due to the lifting by alternately repeating lifting of an inner tank lateral plate using the jack-up unit and attachment of a next inner tank lateral plate to a lower side of the lifted inner tank lateral plate, wherein the method further includes installing a hanging-side jack stand in the sidewall of the concrete outer tank above the roof portion of the concrete outer tank, installing a hanged-side jack stand in the roof portion of the concrete outer tank, and installing the jack-up unit across the hanging-side jack stand and the hanged-side jack stand, and the step of lifting the roof portion of the concrete outer tank includes hoisting the roof portion of the concrete outer tank using the jack-up unit, wherein positions of the hanging-side jack stand and the jack-up unit in a vertical direction can be changed during the step of lifting the roof portion of the concrete outer tank, and wherein the lifting of the roof portion of the concrete outer tank using the jack-up unit and the lifting of the inner tank lateral plate using the jack-up unit are performed independently and in parallel with each other.

2. The method for constructing a cylindrical tank according to claim 1, comprising:

a step of assembling the roof portion of the concrete outer tank in a state in which the roof portion is held on the sidewall of the concrete outer tank.

3. The method for constructing a cylindrical tank according to claim 2, wherein during the step of assembling the roof portion of the concrete outer tank in the state in which the roof portion is held on the sidewall of the concrete outer tank, building up of the sidewall of the concrete outer tank continues.

4. The method for constructing a cylindrical tank according to claim 3, wherein during the step of assembling the roof portion of the concrete outer tank in the state in which the roof portion is held on the sidewall of the concrete outer tank, assembling of the metallic inner tank continues.

5. The method for constructing a cylindrical tank according to claim 1, wherein the sidewall of the concrete outer tank is built up by placing concrete using an outer tank lateral plate as an inner side mold, the method comprising:

a step of forming an opening portion in the outer tank lateral plate in advance;

a step of fitting an anchor portion which is connected to an anchor that is embedded in concrete in the opening portion of the outer tank lateral plate; and a step of supporting the jack-up unit via the anchor portion that is fitted in the opening portion of the outer tank lateral plate.

6. The method for constructing a cylindrical tank according to claim 5, wherein the anchor portion comprises an anchor plate secured to both the anchor and to the outer tank lateral plate.

7. The method for constructing a cylindrical tank according to claim 1, comprising:

a step of providing the jack-up unit at a top portion of the sidewall of the concrete outer tank after the sidewall of the concrete outer tank is built up to lift the roof portion of the concrete outer tank;

a step of providing a protruding portion on an inner circumferential face of the sidewall of the concrete outer tank to regulate a height at which the roof portion of the concrete outer tank is lifted; and a step of attaching the roof portion of the concrete outer tank whose height is regulated by the protruding portion to the inner circumferential face of the sidewall of the concrete outer tank via a coupler.

8. The method for constructing a cylindrical tank according to claim 1, comprising:

a step of assembling the roof portion of the concrete outer tank on a plurality of trestles located on the base portion.

* * * * *